US007875161B2

(12) United States Patent
Briles

(10) Patent No.: US 7,875,161 B2
(45) Date of Patent: Jan. 25, 2011

(54) METHOD FOR ELECTRODEPOSITING A COATING ON AN INTERIOR SURFACE

(75) Inventor: Owen M. Briles, Cherry Valley, IL (US)

(73) Assignee: Hamilton Sundstrand Corporation, Rockford, IL (US)

( * ) Notice: Subject to any disclaimer, the term of this patent is extended or adjusted under 35 U.S.C. 154(b) by 1062 days.

(21) Appl. No.: 11/648,225

(22) Filed: Dec. 28, 2006

(65) Prior Publication Data

US 2008/0156647 A1 Jul. 3, 2008

(51) Int. Cl.
*C25B 1/00* (2006.01)

(52) U.S. Cl. ..... 204/479; 204/471

(58) Field of Classification Search ..... 205/131, 205/317; 204/471, 479
See application file for complete search history.

(56) References Cited

U.S. PATENT DOCUMENTS 3,544,440 A * 12/1970 Weigel ..... 205/317
4,120,994 A * 10/1978 Inoue ..... 427/239
4,624,750 A * 11/1986 Malagola et al. ..... 205/131
4,826,578 A * 5/1989 Masuda et al. ..... 205/104
5,202,383 A 4/1993 Moriarty et al.
5,516,415 A * 5/1996 Palumbo et al. ..... 205/73
5,660,705 A * 8/1997 Michaut ..... 205/115
5,728,283 A * 3/1998 Reuter et al. ..... 204/499
6,790,331 B2 9/2004 Katsumaru et al.

OTHER PUBLICATIONS

"Electrophoretic deposition", from http://en.wikipedia.org/wiki/Electrophoretic_deposition, visited Nov. 28, 2006 (7 pages).
"E-Coat Capabilities", from http://www.ppg.com/car_indcoat/electro2.htm, visited Nov. 27, 2006 (1 page).
"E-Coat Products", from http://www.ppg.com/car_indcoat/electro8.htm, visited Nov. 27, 2006 (4 pages).
"Welcome to Oklahoma Custom Coating!", from http://www.okcustomcoating.com/home.html, visited Nov. 27, 2006 (2 pages).
"Throwing Power", from http://www.okcustomcoating.com/home/throwingpower.html, visited Nov. 27, 2006 (1 page).

(Continued)

*Primary Examiner*—Luan V Van
(74) *Attorney, Agent, or Firm*—Kinney & Lange, P.A.

(57) ABSTRACT

A method of applying a coating to an internal surface of a device includes applying an electric current through an interior space of the device to electrodeposit resin particles onto a first portion of the internal surface and curing the resin particles to form a coating on the first portion of the internal surface. The method further includes repeating an application of the electric current through the interior space of the device to electrodeposit resin particles onto a second portion of the internal surface and curing the resin particles to form a coating on the second portion of the internal surface. The application of the electric current through the interior space and the curing of the resin particles may be repeated until a coating is formed on all of the internal surface.

22 Claims, 6 Drawing Sheets

OTHER PUBLICATIONS

"So, How Does E-Coat Work?", from http://www.okcustomcoating.com/home/howdoescoatwork.html, visited Nov. 27, 2006 (1 page).

Oklahoma Custom Coating Brochure, from http://www.okcustomcoating com, visited on Nov. 27, 2006 (5 pages).

Oklahoma Custom Coating "Advanced Coil Coating" Brochure, from http://www.okcustomcoating.com, visited on Nov. 27, 2006 (5 pages).

* cited by examiner

METHOD FOR ELECTRODEPOSITING A COATING ON AN INTERIOR SURFACE

BACKGROUND OF THE INVENTION

The present invention relates to a method of applying a protective coating to an interior surface. More specifically, the present invention relates to a method of electrodepositing a thin coating uniformly to all interior surfaces of a device.

A coating may commonly be applied to metal surfaces to form a protective layer, such as for corrosion resistance. In many applications it may be important that the coating be thin, yet uniformly applied to the surface. For example, if the coating is for an interior or an exterior of a heat exchanger, it may be important to minimize a thickness of the coating in order to minimize heat transfer losses.

Electrodeposition may commonly be used to apply a coating to a metal surface. However, it may be difficult to uniformly apply a thin coating to interior surfaces of a device, particularly devices having complex shapes and/or small passageways.

BRIEF SUMMARY OF THE INVENTION

The present invention relates to a method of applying a coating to an internal surface of a device. The method comprises applying an electric current through an interior space of the device to electrodeposit resin particles onto a first portion of the internal surface and curing the resin particles to form a coating on the first portion of the internal surface. The method further comprises repeating an application of the electric current through the interior space of the device to electrodeposit resin particles onto a second portion of the internal surface and curing the resin particles to form a coating on the second portion of the internal surface. The application of the electric current through the interior space and the curing of the resin particles may be repeated until a coating is formed on all of the internal surface.

DETAILED DESCRIPTION

A method is described herein for electrodepositing a thin coating on internal surfaces of a device. The method is well-suited for complex shaped devices that may include areas that are commonly hard to reach and present a challenge to uniformly coating all interior areas of the device.

Electrodeposition or electroplating may be used to coat a metal surface of a device with a resin using electric current. A flow of current from an anode causes resin particles to be deposited onto the surface of the grounded metal device. The deposited resin may then be cured to form a protective coating, which may be used, for example, for corrosion resistance.

The electrodeposition process may be used for applying a coating to internal surfaces of a device. However, if a single application of current is applied to the anode, it may be difficult to deposit resin particles on the surface of recessed areas of the device. This may be due in part to an inability to place the anode inside the device or in proximity to all interior spaces of the device. In that case, the resin particles may deposit on a portion of the internal surface located closest to the anode.

Once the deposited resin particles are cured on the metal surface to form a hardened coating, the coating may insulate the metal surface from further deposition of resin particles. Thus, as described in further detail below, the insulative properties of the coating may be used, in a subsequent application of current and additional resin, to drive the flow of current from the anode further into the recesses of the device. This method makes it feasible to uniformly apply a thin protective coating to all interior surfaces of a complex shaped device, such as a heat exchanger or a radiator.

Figure 1:
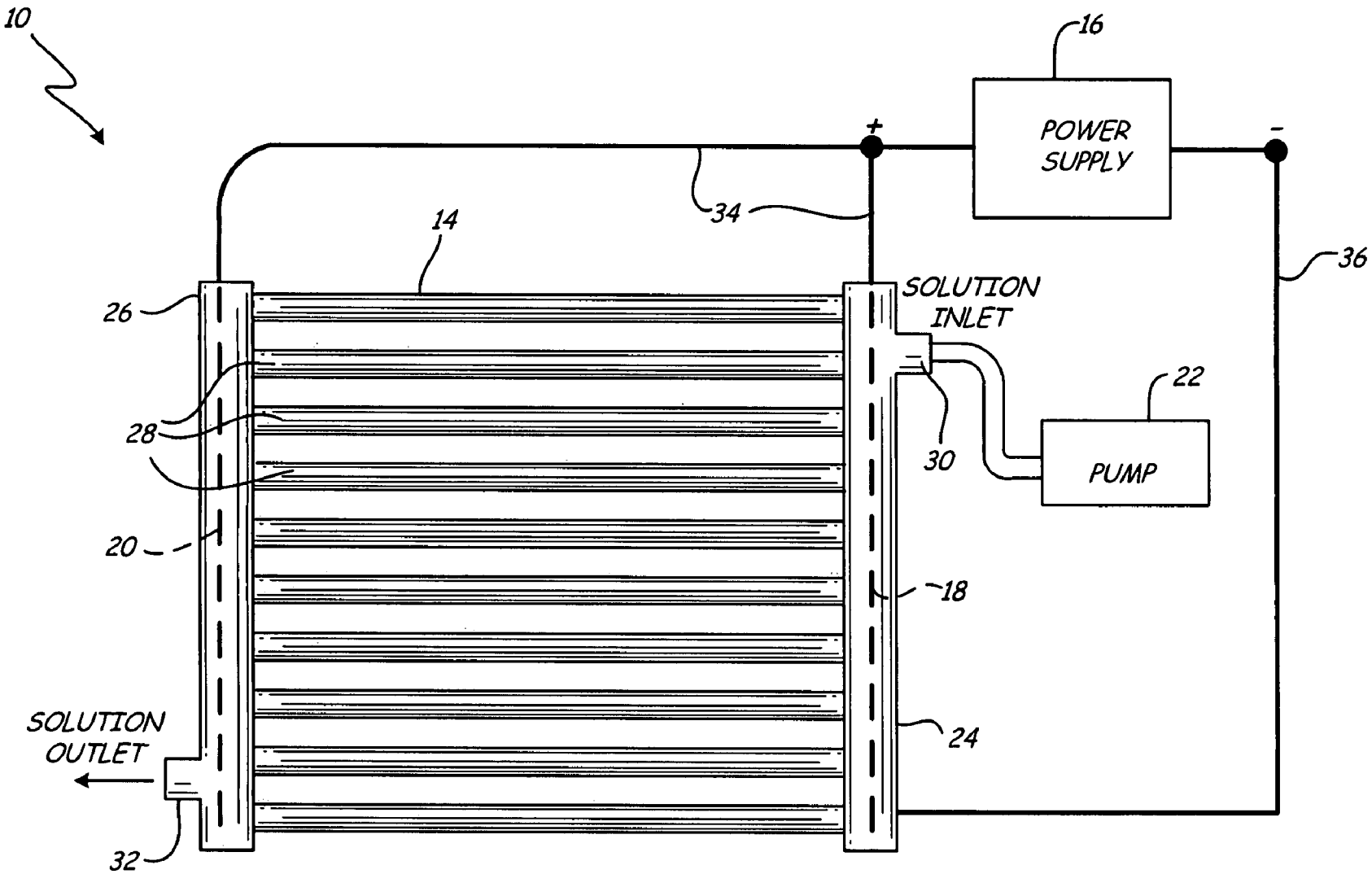
FIG. 1 is a schematic of a system that may be used for applying a coating to interior surfaces of a complex shaped device.

FIG. 1 is a schematic of system 10 for applying a coating (not shown in FIG. 1) to interior surfaces of device 14. System 10 includes DC power supply 16, first anode 18, second anode 20, and pump 22. Device 14 is a heat exchanger having first reservoir 24, second reservoir 26, and a plurality of tubes 28. In the exemplary embodiment of FIG. 1, device 14, including tubes 28, is made from aluminum; first and second reservoirs 24 and 26 are approximately 1 inch in diameter and 20 inches in length, and tubes 28 are approximately 25 inches in length and less than 12 inch in diameter. Although not shown in FIG. 1, the heat exchanger may include fins that cover all of tubes 28 and are configured for dispersing heat. Device 14 is representative of a type of complex shaped device that may be coated by electrodeposition using the method described herein; it is recognized that this method may be used for applying a coating to any type of device.

First reservoir 24 of device 14 is configured as an entrance reservoir and includes inlet port 30, and second reservoir 26 is configured as an exit reservoir and includes outlet port 32. As such, resin may be delivered from pump 22 into device 14 through inlet port 30 and out of device 14 through outlet port 32. (Inlet and outlet ports 30 and 32 may similarly be used for pumping or circulating fluid through device 14 during operation of device 14 for heat exchange.)

Tubes 28 may be long and narrow, making it difficult to deposit resin into a center portion of each of tubes 28. In some embodiments, tubes 28 may have a flattened shape, as opposed to having a circular diameter. Using system 10, it is possible to apply a uniform coating to all interior surfaces of device 14, including all interior surfaces of tubes 28.

In system 10, DC power supply 16 has a positive terminal (designated as + in FIG. 1), which is connected to first and second anodes 18 and 20 by wires 34 in order to deliver a positive potential to first and second anodes 18 and 20. Similarly, DC power supply 16 has a negative terminal (designated as – in FIG. 1), which is connected to device 14 by wires 36. Power supply 16 delivers a negative potential to device 14 (i.e. a cathode). Voltage from power supply 16 is the difference in potential between the positive terminal and the negative terminal.

The electric field between the positively charged anodes 18 and 20 and the negatively charged cathode (i.e. device 14) causes resin particles (not shown) being pumped through an interior of device 14 to be attracted to and deposit onto the negatively charged metal surfaces of device 14. System 10 uses a cathodic electrocoating process, meaning that the resin particles deposit onto a negatively charged surface (device 14), which is the cathode. In alternative embodiments, an anodic electrocoating process may be used; in that case, the terminals are reversed, such that device 14 is positively charged (i.e. an anode) and an anodic resin may be deposited onto the positively charged metal surface of device 14.

Figure 2A:
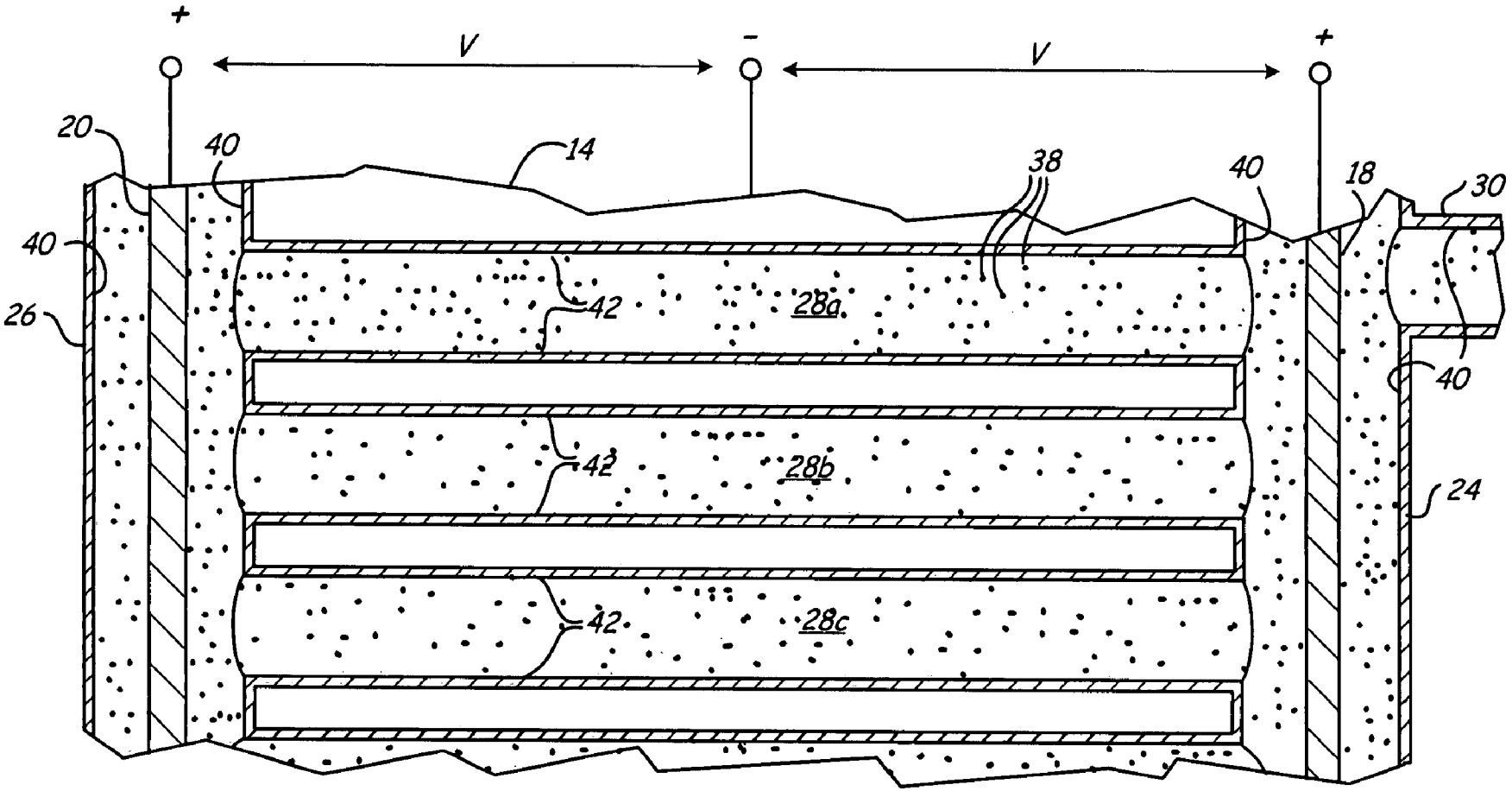
FIGS. 2A-2E are cross-sectional views of an enlarged portion of the system of FIG. 1 illustrating a method for coating the interior surfaces of the device. Note that the drawings are not to scale.

FIGS. 2A-2E illustrate general steps for using system 10 of FIG. 1 to uniformly apply a coating to all interior surfaces of device 14. FIG. 2A shows a cross-sectional view of a portion of device 14 of FIG. 1, including first reservoir 24 having inlet port 30, second reservoir 26, tubes 28*a*, 28*b*, and 28*c*, first anode 18 in first reservoir 24, and second anode 20 in second reservoir 26.

By using pump 22 (see FIG. 1) to inject a solution of resin into device 14 through inlet port 30, as shown in FIG. 2A, resin particles 38 occupy all interior spaces of tubes 28*a*, 28*b*, and 28*c*, as well as first reservoir 24 and second reservoir 26. Prior to injecting the resin solution into device 14, it may be important to remove any air from an interior of device 14 so that resin particles 38 are able to occupy all interior spaces within device 14.

The resin solution may be any type of solution suitable for forming a coating on a metal surface, including, but not limited to an organic coating, such as an epoxy. In some cases, a particular resin may be designed for only a cathodic electrocoating process or only an anodic electrocoating process. For example, since system 10 uses a cathodic electrocoating process, the resin solution that includes resin particles 38 is a cathodic resin that is configured to deposit onto the negatively charged surface of device 14. If system 10 alternatively used an anodic electrocoating process, an anodic resin may be used.

As described above in reference to FIG. 1, and as also shown in FIG. 2, anodes 18 and 20 are each connected to positive terminal (+) of power supply 16, and device 14 is connected to negative terminal (−) of power supply 16. The difference in potential is represented by voltage V in FIG. 2A. (All surfaces of device 14, including reservoirs 24 and 26, inlet 30 and tubes 28, have an equal potential.)

As current flows as a result of voltage V, resin particles 38 are attracted to the negative charge on the bare metal surfaces of device 14, including interior surfaces 40 of first and second reservoirs 24 and 26, and interior surfaces 42 of tubes 28*a*, 28*b* and 28*c*. The attractive forces between the resin and the metal cause particles 38 to deposit onto interior surfaces 40 and 42. A thickness of a coating formed by resin particles 38 on interior surfaces 40 and 42 is a function in part of voltage V. Thus, voltage V may be controlled in order to control the thickness of the coating, as explained in further detail below.

Figure 2B:
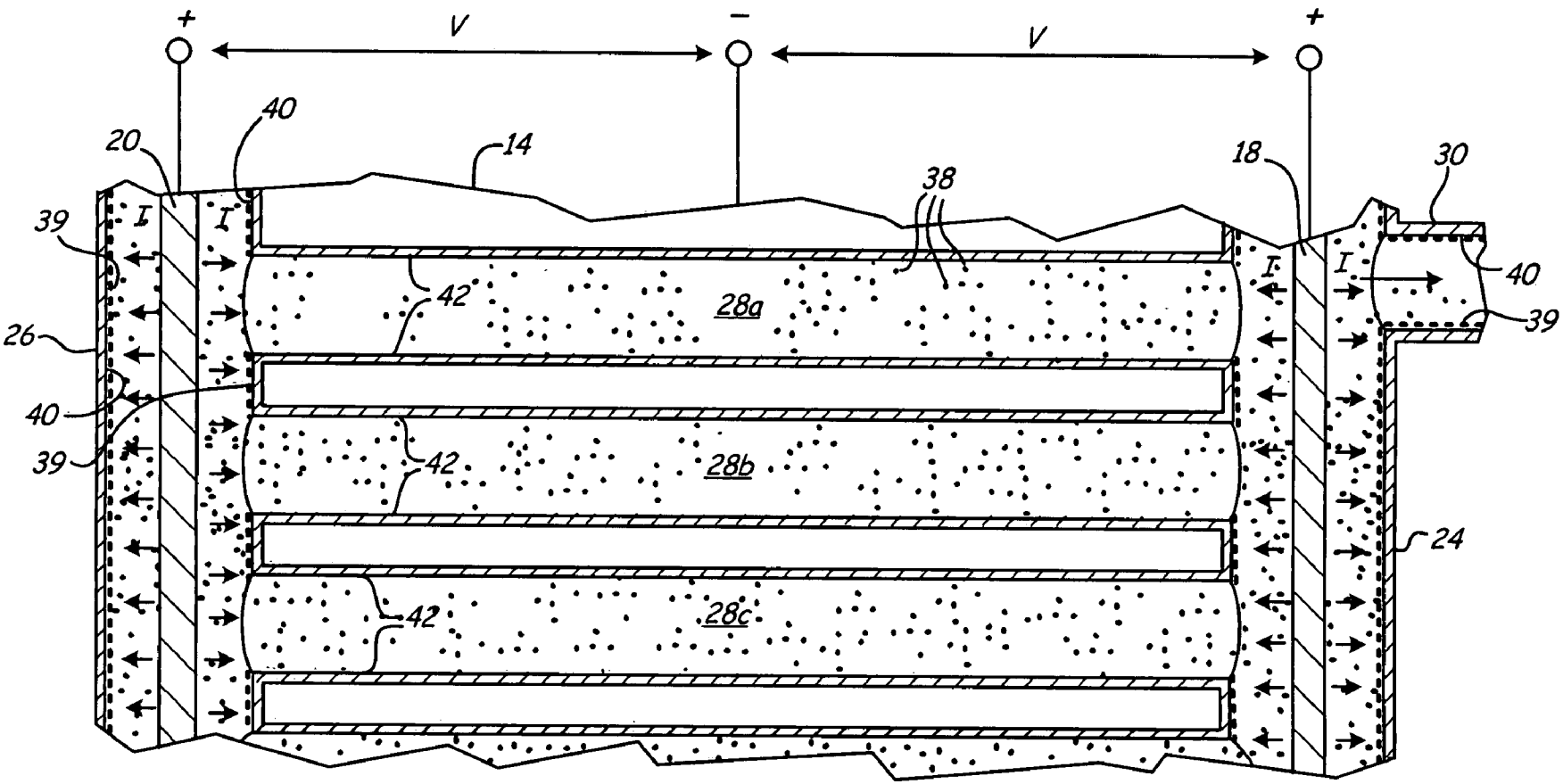

FIG. 2B shows electric current I flowing, as a result of voltage V, from positive anodes 18 and 20 towards negative surfaces 40 of device 14. Electric current I causes resin particles 39 to deposit onto interior surfaces 40 of first and second reservoirs 24 and 26 to form a coating. In this first application of current I through device 14, particles 39 deposit onto interior surfaces 40 of reservoirs 24 and 26 because these surfaces are closest to first and second anodes 18 and 20. (Once resin particles 38 are deposited onto an interior surface of device 14, the particles are designated in FIGS. 2B-2E as particles 39.) A thickness of the coating formed by particles 39 is controlled by voltage V. As more resin particles 39 deposit onto interior surfaces 40, resistance increases. Current is equal to voltage divided by resistance. Assuming voltage V remains constant, current I decreases as more particles 39 are deposited on interior surfaces 40, causing a deposition rate on interior surfaces 40 to slow over time. As discussed below, experiments may be done to determine a value or range of values for voltage V, and a duration of time for delivering voltage V, based on a target thickness of coating 44.

After resin particles 39 are deposited onto interior surfaces 40, a next step is to cure resin particles 39 such that the resin particles harden and form coating 44 on interior surfaces 40. Prior to a curing process, a rinse solution may be pumped through the interior of device 14. In addition, deionized water may be flushed through the interior. At that point, anodes 18 and 20 may be removed from device 14. The curing of particles 39 to form coating 44 may be performed by exposing device 14 to a high temperature.

The steps described above are then repeated in order to deposit resin particles onto interior surfaces 42 of tubes 28*a*, 28*b* and 28*c*. Thus, anodes 18 and 20 are inserted back into first and second reservoirs 24 and 26. Resin particles 38 are again pumped through interior surfaces of device 14, and voltage V is redelivered from power supply 16 to anodes 18 and 20.

Figure 2C:
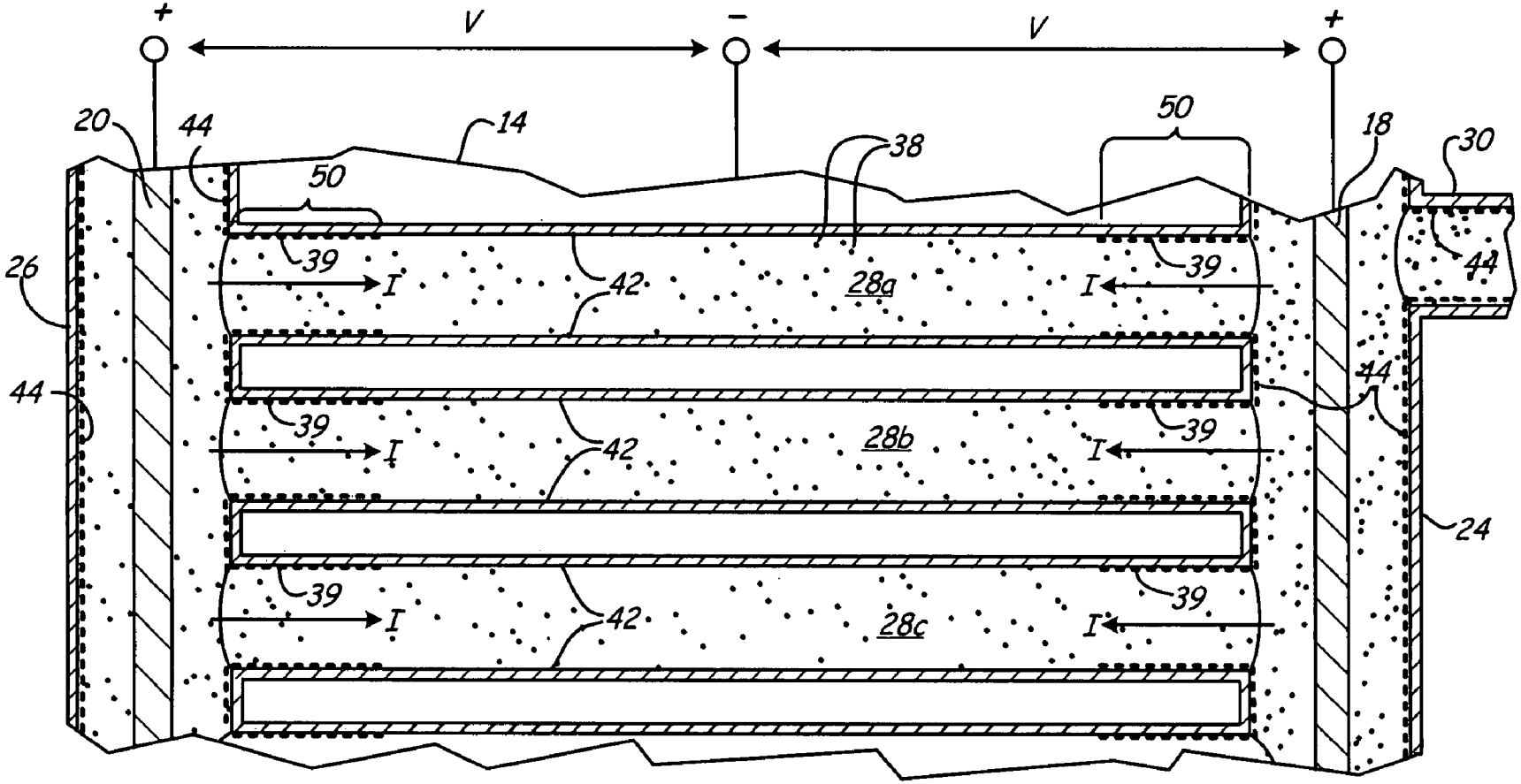

FIG. 2C shows a second delivery of voltage V, created by a potential difference between positively charged anodes 18 and 20 and the negatively charged cathode (device 14). As described above, current I flows as a result of voltage V and the electric field causes resin particles 38 to be attracted to the negatively charged metal surfaces of device 14. However, a portion of the metal surfaces of device 14, specifically interior surfaces 40 of first and second reservoirs 24 and 26, now have cured coating 44 formed on the surface. Cured coating 44 on interior surfaces 40 of second reservoirs 24 and 26 now insulates interior surfaces 40 such that resin particles 38 are no longer attracted to interior surfaces 40. (Once the resin is cured, the insulative properties of the resin are far greater compared to uncured resin particles deposited on the surface.) As a result of the insulative properties of coating 44, current I is driven into an interior of each of tubes 28*a*, 28*b*, and 28*c*, causing resin particles 39 to be deposited onto first portion 50 of interior surfaces 42 of tubes 28*a*, 28*b* and 28*c*. As shown in FIG. 2C, for each of tubes 28*a*, 28*b* and 28*c*, resin p articles 39 deposit onto first portions 50 of interior surfaces 42 at each end of each tube. Because anodes 18 and 20 are essentially identical and receive an equal voltage, resin particles 39 deposit onto interior surfaces 42 in a similar manner starting from each end of each tube and working toward a middle of each tube.

As described above in reference to FIG. 2B, a thickness of resin particles 39 deposited onto interior surface 42 may be controlled through the quantity of voltage delivered to anodes 18 and 20, and the duration of time that the voltage is delivered.

Once voltage V has been applied for the designated time, power supply 16 may be turned off and anodes 18 and 20 may be removed from device 14, and the interior of device 14 may be flushed out as described above. The same curing process may then be used to cure resin particles 39 formed on first portions 50 of interior surfaces 42 to form coating 44 (see FIG. 2D).

Figure 2D:
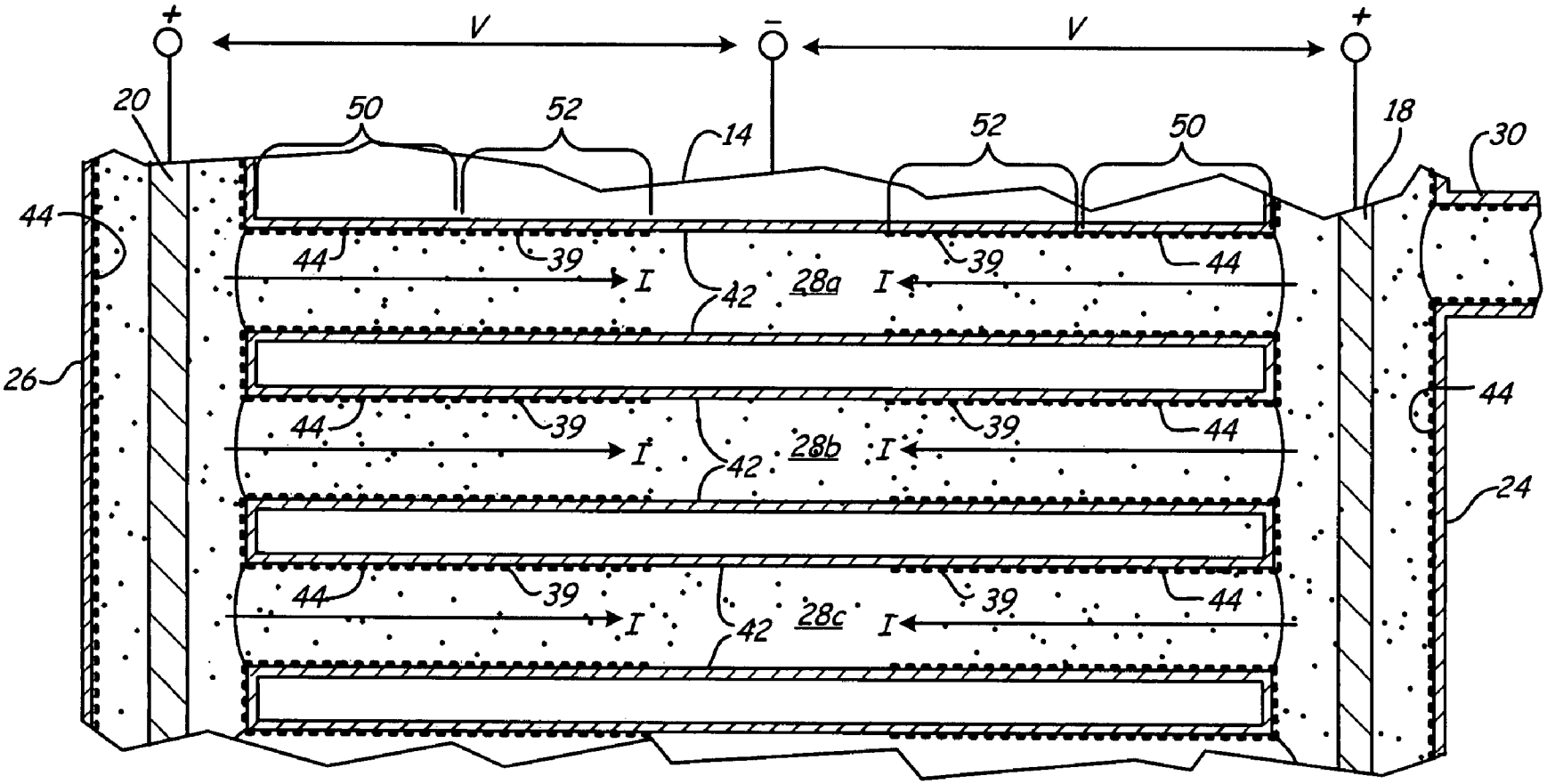
Figure 2E:
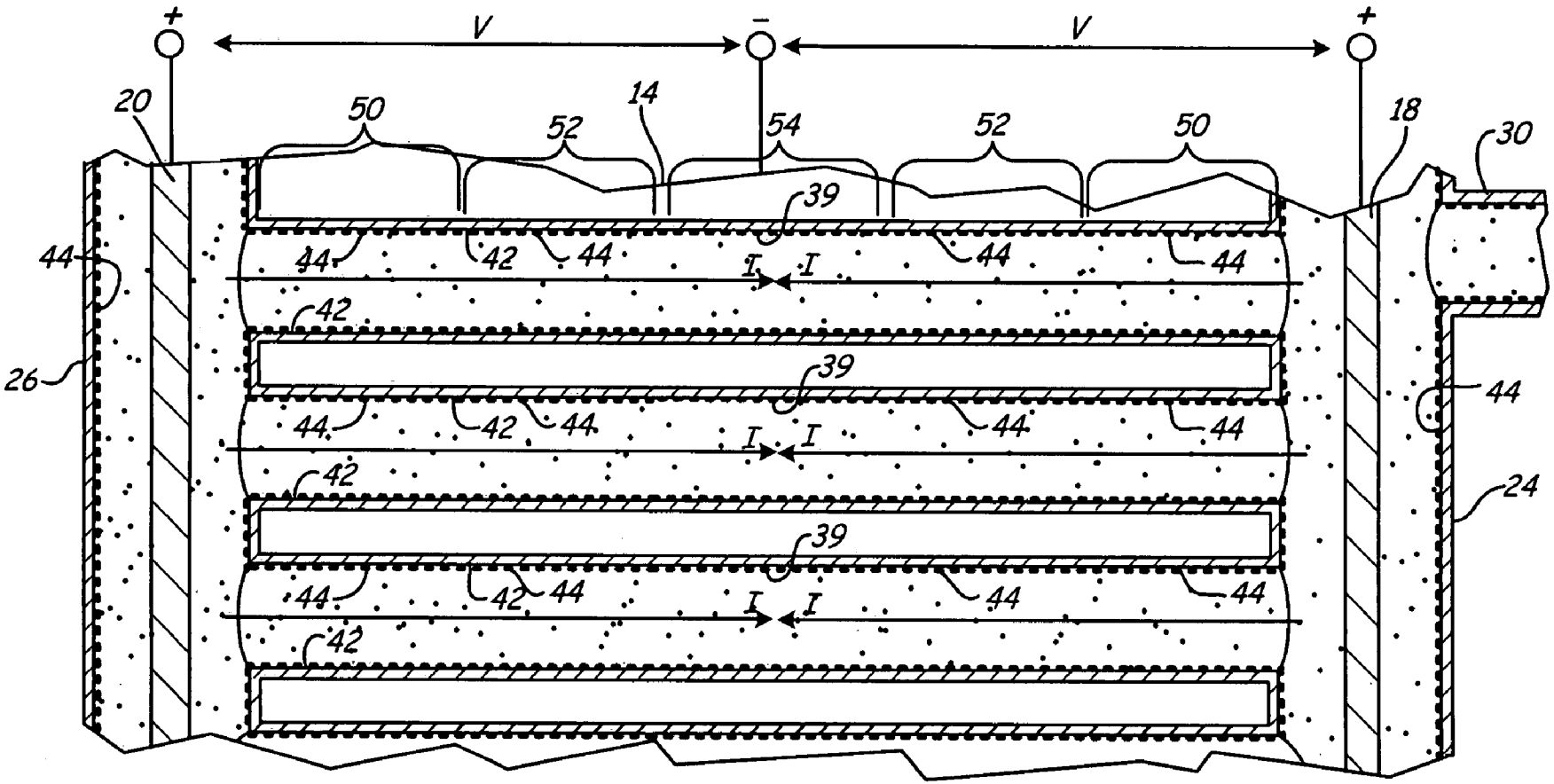

FIG. 2D shows a third delivery of voltage V to anodes 18 and 20. At this point, coating 44 on first portions 50 of interior surfaces 42 of tubes 28*a*, 28*b*, and 28*c* forms an insulative layer for the ends of each tube. As such, current I is driven further into each tube and resin particles 39 deposit onto second portions 52 of interior surfaces 42 of tubes 28*a*, 28*b* and 28*c*. Subsequent steps are identical to the steps described above under FIG. 2C in order to form cured coating 44 on second portions 52 of interior surfaces 42. In this case, by applying the same voltage V to anodes 18 and 20 as was applied in the second delivery of voltage V (see FIG. 2C), coating 44 deposited onto second portions 52 has a thickness approximately equal to coating 44 formed on first portions 50.

Finally, in FIG. 2D, a fourth delivery of voltage V to anodes 18 and 20 drives current I far enough into tubes 28 such that resin particles 39 are deposited on a middle portion (third portion 54) of each tube. A final cure is completed such that coating 44 is uniformly applied to all interior surfaces of device 14.

In an exemplary embodiment of system 10, the electrocoating process, as shown in FIGS. 2A-2E, was performed a total of four times to coat all interior surfaces of device 14. It is recognized that the electrocoating process may be performed more than four times or less than four times depending on a shape and size of the device to be coated and a desired thickness of the coating. In an exemplary embodiment, to form coating 44 on tubes 28 (see FIGS. 2C-2E), voltage V was equal in each application to approximately 90 volts and this voltage was delivered by power supply 16 for approximately 20 minutes.

As stated above, a thickness of coating 44 may be controlled as a function of how much voltage is applied to anodes 18 and 20 and for how long. In order to determine a value or a range of values for voltage V for coating interior surfaces 42 of tubes 28, experiments may be done on individual tubes having similar dimensions to tubes 28. After each deposition of resin particles 39 and a curing process, the tube may be cut open or otherwise examined to determine a thickness of the coating and how far the coating penetrated into an interior of the tube. If these experiments are performed over a range of voltages for a given time and a given tube size, it may be possible to determine a thickness of the coating formed as a function of the voltage. Moreover, the experiments may be used to determine how many times the process must be repeated to coat all of the interior of the tube.

In the exemplary embodiment of FIGS. 1 and 2A-2E, device 14 is a heat exchanger that may be used for an aircraft. However, it is recognized that the method described herein may be used for coating an interior of any type of device, including, but not limited to, other types of heat exchangers and any type of radiator.

Although the present invention has been described with reference to preferred embodiments, workers skilled in the art will recognize that changes may be made in form and detail without departing from the spirit and scope of the invention.

The invention claimed is:

1. A method of applying a coating to an internal surface of a device, the method comprising:

applying a voltage to an anode to create an electric current through an interior space of the device to electrodeposit resin particles onto a first portion of the internal surface, wherein the interior space is surrounded by the internal surface and the internal surface includes the first portion and a second portion;

curing the resin particles to form a coating on the first portion of the internal surface;

repeating an application of the electric current through the interior space of the device to electrodeposit resin particles onto the second portion of the internal surface; and curing the resin particles to form a coating on the second portion of the internal surface, wherein the first portion of the internal surface is closer to the anode than the second portion of the internal surface.

2. The method of claim 1 wherein the coating on the first portion of the internal surface and the coating on the second portion of the internal surface have a substantially uniform thickness.

3. The method of claim 1 further comprising repeating an application of the electric current through the interior space and repeating a cure of the resin particles until a coating is formed on all of the internal surface.

4. The method of claim 1 wherein the coating formed on the first portion of the internal surface insulates the internal surface and prevents any additional coating from forming on the first portion of the internal surface when the application of the current is repeated.

5. The method of claim 1 wherein applying an electric current through the interior space includes using a DC power supply to deliver a voltage to at least one anode.

6. The method of claim 5 wherein a thickness of the coating formed on the internal surface is a function of the voltage delivered by the DC power supply.

7. The method of claim 1 wherein the resin particles and the coating are epoxy.

8. A method of electrodepositing a coating on an interior surface of a device, the method comprising:

(a) injecting a solution of resin particles into an interior space, wherein the interior space is surrounded by the interior surface, and wherein the interior surface has a first portion and a second portion;

(b) applying a voltage to an anode to create a flow of a current through the interior space to deposit the resin particles onto the first portion of the interior surface;

(c) curing the resin particles on the first portion of the interior surface to form a coating; and repeating steps (a) through (c) to form a coating on the second portion of the interior surface, wherein the first portion of the interior surface is closer to the anode than the second portion of the interior surface.

9. The method of claim 8 wherein the coating on the interior surface has a substantially uniform thickness.

10. The method of claim 8 wherein the coating formed on the first portion of the interior surface insulates the interior surface and prevents any additional coating from forming on the first portion of the interior surface when the application of the current is repeated.

11. The method of claim 8 wherein applying a current through the interior space includes using a DC power supply and at least one anode.

12. The method of claim 11 wherein applying a current through the interior space is a function of a voltage applied from the DC power supply to the at least one anode.

13. The method of claim 12 wherein a thickness of the coating is a function of the voltage applied from the DC power supply.

14. The method of claim 8 wherein the device is a heat exchanger.

15. A method of applying a coating to interior surfaces of a device having a first channel, a second channel and a plurality of tubes, wherein each tube is located between and perpendicular to the first channel and the second channel, the method comprising:

(a) placing a first anode in the first channel and a second anode in the second channel;

(b) pumping a solution of resin particles through the first channel of the device such that the first and second channels and the tubes are filled with resin particles;

(c) applying a voltage to the first and second anodes to create a flow of current through the first and second channels and into each of the tubes;

(d) depositing resin particles onto a first portion of an interior surface of each of the tubes as a function of current flowing through the tubes, wherein the deposited resin particles form a first coating;

(e) removing the first and second anodes from the device;

(f) emptying the solution from the device;

(g) curing the coating on the first portion of the interior surface of each of the tubes; and repeating steps (a) through (g) to deposit resin particles onto a second portion of the interior surface to form a second coating in each of the tubes, wherein the second coating is located further into the tube relative to the first and second channels.

16. The method of claim 15 wherein steps (a) through (g) are repeated until the interior surface of each of the tubes is completely coated.

17. The method of claim 15 wherein the first anode and the second anode are stainless steel rods.

18. The method of claim 15 wherein the solution is epoxy.

19. The method of claim 15 wherein a thickness of the first and second coatings is uniform.

20. The method of claim 19 wherein the thickness of the first and second coatings is less than approximately 1 mil.

21. The method of claim 15 wherein the device is a heat exchanger.

22. The method of claim 15 wherein applying a voltage to the first and second anodes is performed by a DC power supply.

* * * * *